US011274896B2

(12) United States Patent
Mehta et al.

(10) Patent No.: US 11,274,896 B2
(45) Date of Patent: Mar. 15, 2022

(54) CONVERSION KIT HAVING INTERCHANGEABLE BARREL LINERS

(71) Applicant: UTM LIMITED, Mildenhall (GB)

(72) Inventors: Parag Mehta, Mildenhall (GB); Alan Smith, Mildenhall (GB)

(73) Assignee: UTM LIMITED, Mildenhall (GB)

( * ) Notice: Subject to any disclaimer, the term of this patent is extended or adjusted under 35 U.S.C. 154(b) by 0 days.

(21) Appl. No.: 16/977,388

(22) PCT Filed: Feb. 26, 2019

(86) PCT No.: PCT/GB2019/050516

§ 371 (c)(1),
(2) Date: Sep. 1, 2020

(87) PCT Pub. No.: WO2019/166787

PCT Pub. Date: Sep. 6, 2019

(65) Prior Publication Data

US 2021/0041199 A1 Feb. 11, 2021

(30) Foreign Application Priority Data

Mar. 2, 2018 (GB) ..... 1803407

(51) Int. Cl.
*F41A 21/04* (2006.01)
*F41A 21/10* (2006.01)

(52) U.S. Cl.
CPC ..... *F41A 21/04* (2013.01); *F41A 21/10* (2013.01)

(58) Field of Classification Search
CPC ..... F41A 21/04; F41A 21/10
USPC ..... 42/76.01, 76.1, 77, 78
See application file for complete search history.

(56) References Cited

U.S. PATENT DOCUMENTS 2,975,677 A * 3/1961 Kelly, Jr. ..... B21C 37/153 89/16
3,156,995 A * 11/1964 Mellor ..... F41A 21/10 42/77
3,805,434 A * 4/1974 Sudano ..... F41A 21/10 42/77
4,455,777 A * 6/1984 Callies ..... F41C 7/12 42/59
4,459,774 A * 7/1984 Ferretti ..... F41A 21/10 42/77

(Continued)

FOREIGN PATENT DOCUMENTS

WO 03/033987 A1 4/2003
WO 2019166787 A1 9/2019

OTHER PUBLICATIONS

International Search Report and Written Opinion, PCT/GB2019/050516, dated May 21, 2019, 13 pages.

(Continued)

*Primary Examiner* — Samir Abdosh
(74) *Attorney, Agent, or Firm* — Nelson Mullins Riley & Scarborough LLP; Anthony A Laurentano

(57) ABSTRACT

A conversion kit (1) for converting a firearm to fire a plurality of different types of non-lethal training ammunition comprises a single barrel (2) and a plurality of interchangeable barrel liners (3) which can be used in place of each other. The barrel (2) defines a bore (4) which receives one of the barrel liners (3) for firing non-lethal training ammunition and each barrel liner (3) is specific for a type of non-lethal training ammunition.

18 Claims, 2 Drawing Sheets

(56) References Cited

U.S. PATENT DOCUMENTS

| | | | | | |
|---|---|---|---|---|---|
| 4,648,192 | A * | 3/1987 | Harness | F41A 21/10 | 42/75.04 |
| 4,735,009 | A * | 4/1988 | Jett, Jr. | F41A 21/10 | 102/446 |
| 4,989,359 | A * | 2/1991 | Kinkner | F41A 21/06 | 42/77 |
| 5,657,568 | A * | 8/1997 | Christensen | F41A 21/02 | 42/76.01 |
| 6,823,857 | B2 * | 11/2004 | Perry | F41A 21/04 | 124/83 |
| 7,444,775 | B1 * | 11/2008 | Schuetz | F41A 9/71 | 42/49.02 |
| 7,691,759 | B2 * | 4/2010 | Perry | F41B 11/00 | 442/77 |
| 2002/0078616 | A1 * | 6/2002 | Perry | F41A 21/04 | 42/76.01 |

OTHER PUBLICATIONS

International Preliminary Report on Patentability, PCT/GB2019/050516, dated Sep. 8, 2020, 8 pages.

* cited by examiner

CONVERSION KIT HAVING INTERCHANGEABLE BARREL LINERS

RELATED APPLICATIONS

This application is a 35 U.S.C. 371 national stage filing of International Application PCT/GB2019/050516, filed Feb. 26, 2019, which claims priority to GB 1803407.4 filed on Mar. 2, 2018 in the United Kingdom. The contents of the aforementioned applications are hereby incorporated by reference.

TECHNICAL FIELD

The present invention relates to a conversion kit for converting a firearm to fire various types of non-lethal training ammunition. In particular, the kit is for converting a pistol.

BACKGROUND ART

Conversion kits for use with training ammunition are known. The known conversion kits include a slide assembly and a barrel assembly. The conversion kit slide assembly replaces a slide assembly of the firearm. In addition, the conversion kit barrel assembly replaces the barrel assembly of the firearm.

The barrel assembly generally includes a barrel and a barrel liner, although barrel only pistol conversions are also known. The barrel assembly of the conversion kit is designed so that it will interact with the firearm and the conversion kit slide assembly.

There are various types of liner; each liner allows the firing of a certain type of non-lethal training ammunition.

For example, a known conversion kit for converting a firearm to fire man marker ammunition includes a barrel liner which fits inside the barrel of the firearm. The barrel liner is inserted into the barrel and is held in place with glue to prevent it falling out or moving when in use. Once the liner has been glued in position it is machined to enable the firing of non-lethal man marker training ammunition.

In addition, a further known conversion kit for converting a firearm to fire blank ammunition includes a liner which fits inside a barrel and is held in position with a coiled spring pin.

In addition, a further known conversion kit for converting a firearm to fire alternative man marker ammunition includes a barrel liner which fits inside the barrel of the firearm. The barrel liner is inserted into the barrel and is held in place with glue to prevent it falling out or moving when in use. Once the liner has been glued in position it is machined to enable the firing of alternative non-lethal man marker training ammunition.

The known conversion kits have a number of disadvantages. In this regard, each conversion kit barrel assembly is manufactured to accommodate a specific barrel liner, so a man marker barrel assembly will accommodate a man marker liner but not a bank liner or alternative man marker liner. The known conversion kits do not allow the interchangeability of the barrel liners.

Thus, the user of a firearm is required to use a barrel assembly specific to the ammunition that will be fired. If a user of a firearm would like to use more than one type of training ammunition they are required to use a number of different barrel assemblies covering the different types of ammunition that will be fired to be able to use the range of ammunition available.

This means that the supplier of the barrel assemblies is required to stock an inventory of all types of barrel.

In addition, a problem that arises is that the tooling and production of various barrel assemblies is difficult and costly.

The present invention aims to provide a novel conversion kit which allows more consistent and predictable performance when firing non-lethal ammunition.

In light of the problems discussed above, various proposals have been made, but there remains a need for an improved conversion kit which addresses one or more of the problems presented by prior art arrangements.

Remarkably, the invention provides a new conversion kit wherein a single barrel is manufactured to accommodate a plurality of different liner types. This means that only one barrel type is required to be stocked and the invention provides the advantage that tooling and manufacture of only one type of barrel is required, thereby making the production of the conversion kit easier and more cost effective.

SUMMARY OF INVENTION

In accordance with the first aspect of the present invention there is provided a conversion kit for converting a firearm to fire a plurality of different types of non-lethal training ammunition which comprises a single barrel and a plurality of interchangeable barrel liners which can be used in place of each other, wherein the barrel defines a bore which receives one of the barrel liners for firing non-lethal training ammunition and each barrel liner is specific for a type of non-lethal training ammunition.

Advantageously, the firearm can be easily converted to fire a different type of non-lethal training ammunition by simply changing the barrel liner of the conversion kit for an alternative barrel liner of the conversion kit which is specific for the intended ammunition. It is not necessary to change the barrel of the conversion kit.

The invention provides the advantage that it allows conversion kits having an inventory of a single barrel type to be stocked. The invention would allow a user to purchase a number of ammunition specific liners to convert the barrel to the type of ammunition they wish to use, which would be technically easier and at a greatly reduced cost as opposed to purchasing various complete barrel assemblies. Therefore, the invention provides a more cost effective way to manufacture and stock a conversion kit for a firearm to convert it to fire different types of non-lethal training ammunition.

Preferably, the conversion kit of the invention comprises two or more barrel liners which can be received by the bore of the barrel in place of each other.

Preferably, the conversion kit of the invention comprises three barrel liners which can be received by the bore of the barrel in place of each other.

Preferably, the barrel liners comprise a substantially cylindrical body. Preferably, the body of each barrel liner has a radially outer surface which corresponds to the surface of the bore of the barrel. Preferably, the body of each barrel liner has a radially inner surface which corresponds to a type of non-lethal training ammunition. In an embodiment of a barrel liner, the radially inner surface of the body of the barrel liner has one or more helical grooves. Preferably, the grooves provide riffling to spin a round fired through the liner and preferably will gyro stabilize the flight of the fired round. In an alternative embodiment of a barrel liner for firing blank ammunition, the radially inner surface of the body of the barrel liner has no helical grooves.

Preferably, the barrel liners are in a finished machined state. Advantageously, no further machining is needed after the barrel liner is inserted into the barrel.

Preferably, the conversion kit comprises a retaining pin wherein a barrel liner is inserted into the barrel and held in position with the retaining pin. This allows the barrel liners to be interchangeable.

Advantageously, one barrel liner can be easily swapped for a different barrel liner by removing the retaining pin, changing the barrel liner for an alternative barrel liner and reinserting the retaining pin.

Preferably, the retaining pin is a coiled spring pin. This has the advantage of the pin being retained securely.

Preferably, the pin engages in a channel through the barrel which is substantially perpendicular to the bore of the barrel and/or the longitudinal axis of the barrel. Preferably, the barrel has an upper surface and a lower surface in use and the channel is located proximal to the upper surface.

Preferably, the pin engages in a groove or notch in a radially outer surface of the barrel liner to retain the barrel liner in position relative to the barrel for firing ammunition.

Preferably, each barrel liner fits in the barrel with substantially no gap between the barrel and the barrel liner.

Preferably, the bore of the barrel is substantially axial and substantially parallel with the longitudinal axis of the barrel. In this regard, preferably, the longitudinal axis of the bore of the barrel is at an angle to the longitudinal axis of the barrel at about 1° to about 5°. In other words, the barrel has a radially inner surface and a radially outer surface, wherein the radially inner surface defines a cylinder having a longitudinal axis at an angle of about 1° to about 5° to the longitudinal axis of a cylinder defined by the radially outer surface of the barrel. Preferably, in use, the longitudinal axis of the bore of the barrel and the longitudinal axis of the barrel are coplanar and in a substantially vertical and/or horizontal plane.

In a second aspect, the invention provides a firearm comprising a conversion kit of the invention.

Preferably, the firearm is a pistol.

BRIEF DESCRIPTION OF DRAWINGS

For the purposes of exemplification, the invention will now be further described with reference to the following Figures in which.

DESCRIPTION OF ILLUSTRATED EMBODIMENT

It will be appreciated that aspects, embodiments and preferred features of the invention have been described herein in a way that allows the specification to be written in a clear and concise way. However, unless circumstances clearly dictate otherwise, aspects, embodiments and preferred features can be variously combined or separated in accordance with the invention. In a preferred embodiment, a device in accordance with the invention comprises all aspects of the invention.

Within the context of this specification, the word "about" means preferably plus or minus 20%, more preferably plus or minus 10%, even more preferably plus or minus 5%, most preferably plus or minus 2%.

Within the context of this specification, the word "comprises" means "includes, among other things" and should not be construed to mean "consists of only".

Within the context of this specification, the word "substantially" means preferably at least 90%, more preferably 95%, even more preferably 98%, most preferably 99%.

Figure 1:
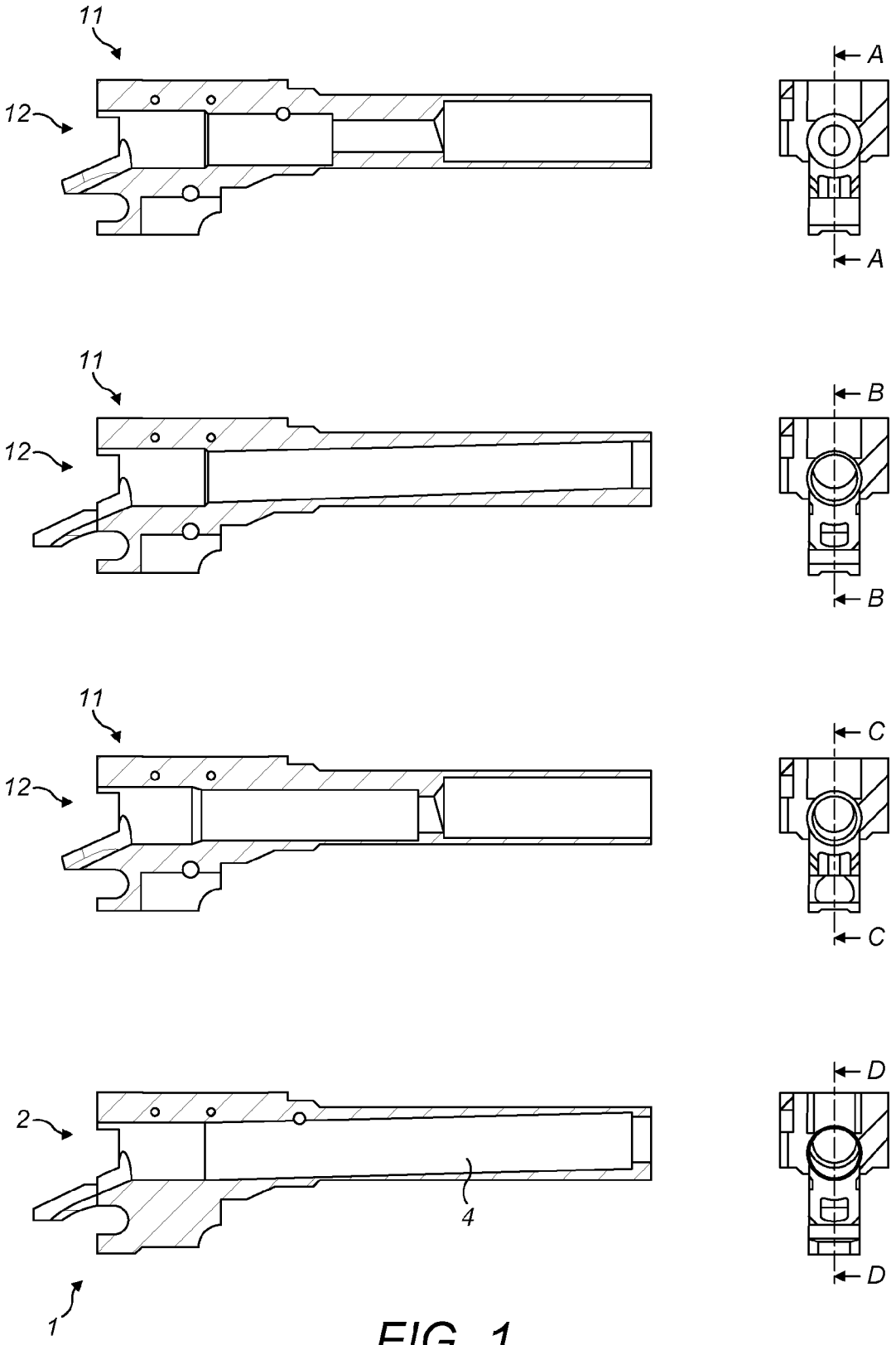
FIG. 1 shows barrels (12) of known conversion kits (11) along with a cross sectional view of a barrel (2) of a conversion kit (1) of the invention. Cross sections A, B & C show the barrel configurations of known conversion kits. Section D-D shows an internal view of a barrel of the conversion kit of the invention. It can be seen that the conversion kit (1) of the invention differs from all of the known conversion kits (11). In this regard, the internal diameter of the drilled hole (4) is larger in diameter than section B-B and differs in structure to Section A-A & C-C so that it can receive various barrel liners (3) specific to different types of ammunition.

With reference to the Figures, FIG. 1 shows barrels (12) of known conversion kits (11). In addition, it illustrates a typical embodiment of a barrel (2) of a conversion kit (1) of the invention. Cross sections A, B & C show the barrel (12) configurations of known conversion kits whereas section D-D shows a cross sectional view of a barrel (2) of the conversion kit (1) of the invention.

It can be seen that the conversion kit (1) of the invention differs from all of the known conversion kits (11). In this regard, the internal diameter of the drilled hole (4) in section D-D is larger in diameter than the one in section B-B and differs in structure to those in Sections A-A & C-C so that it can receive various barrel liners (3) specific to different types of ammunition.

Figure 2:
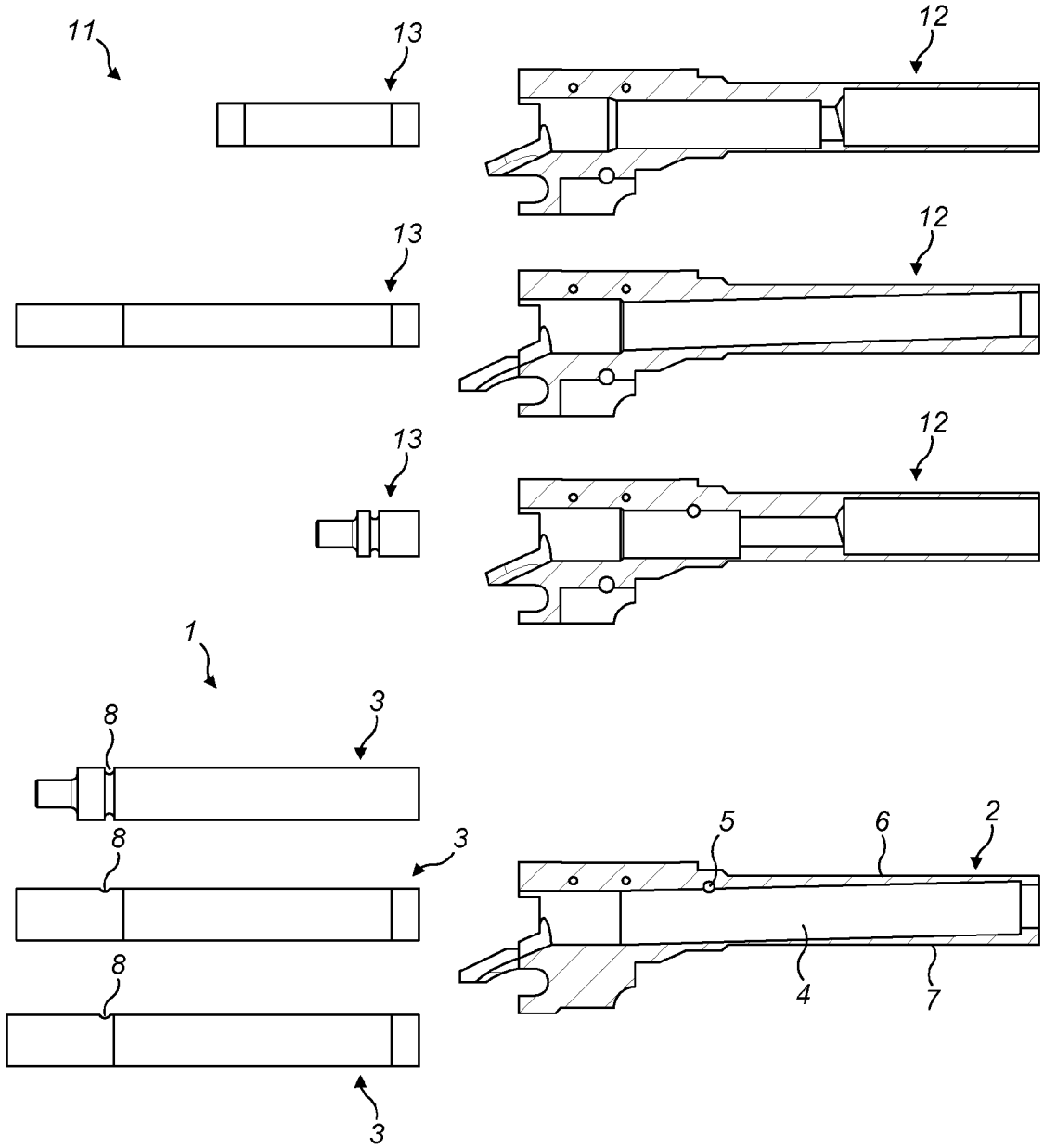
FIG. 2, shows barrels (12) and the corresponding barrel liners (13) of known conversion kits (11). Also shown is an embodiment of a conversion kit (1) according to the invention showing three barrel liners (3) that all fit with the single barrel (2).

FIG. 2 illustrates barrels (12) and the corresponding barrel liners (13) of known conversion kits (11). The figure also shows an embodiment of a conversion kit (1) according to the invention showing three barrel liners (3) that all fit with the single barrel (2).

The barrel (2) defines a bore (4) which is substantially axial and substantially parallel with the longitudinal axis of the barrel (2). In this regard, in use, as shown in FIG. 2, the longitudinal axis of the bore (4) of the barrel (2) meets the longitudinal axis of the barrel (2) at about 1° to about 5°.

The conversion kit (1) shown in the Figure comprises three barrel liners (3) which have bodies that are substantially cylindrical. In this regard, each barrel liner (3) has a radially outer surface which corresponds to the surface of the bore (4) of the barrel (2). Each barrel liner (3) has a radially inner surface which corresponds to a type of non-lethal training ammunition. In an embodiment, the radially inner surface of a barrel liner (3) has one or more helical grooves which provide riffling to spin a round fired through the liner and gyro stabilize the flight of the fired round. No grooves are provided in the bore of a barrel liner (3) for firing blank ammunition.

The barrel liners (3) are inserted into the bore (4) of the barrel (2) in a finished machined state and held in position with a retaining pin in the form of a coiled spring pin. This allows the liners to be interchangeable. One barrel liner (3) can be easily swapped for a different barrel liner (3) by removing the retaining pin, changing the barrel liner (3) for an alternative barrel liner (3) and reinserting the retaining pin.

The retaining pin engages in a channel (5) through the barrel (2) which is substantially perpendicular to the bore (4) of the barrel (2) and/or the longitudinal axis of the barrel (2). The barrel (2) has an upper surface (6) and a lower surface (7) in use and the channel (5) is located proximal to the upper surface (6).

The retaining pin engages in a groove or notch (8) in a radially outer surface of the barrel liner (3) to retain the barrel liner (3) in position relative to the barrel for firing ammunition. In this regard, each barrel liner (3) fits in the bore (4) of the barrel (2) with substantially no gap between the barrel (2) and the barrel liner (3).

The above described embodiments have been given by way of example only, and the skilled reader will naturally appreciate that many variations could be made thereto without departing from the scope of the invention.

The invention claimed is:

1. A conversion kit for converting a firearm to fire a plurality of different types of nonlethal training ammunition which comprises a single barrel and a plurality of interchangeable barrel liners which can be used in place of each other, wherein the barrel defines a bore which receives one of the barrel liners for firing nonlethal training ammunition and each barrel liner is specific for a type of non-lethal training ammunition, and a retaining pin, wherein one of the plurality of barrel liners is inserted into the barrel and is held in position with the retaining pin.

2. A conversion kit according to claim 1 wherein the kit comprises two or more barrel liners which can be received by the bore of the barrel in place of each other.

3. A conversion kit according to claim 1, wherein the conversion kit comprises three barrel liners which can be received by the bore of the barrel in place of each other.

4. A conversion kit according to claim 1, wherein the barrel liners comprise a substantially cylindrical body.

5. A conversion kit according to claim 4 wherein the body of each barrel liner has a radially outer surface which corresponds to the surface of the bore of the barrel.

6. A conversion kit according to claim 5 wherein the body of each barrel liner has a radially inner surface which corresponds to a type of non-lethal training ammunition.

7. A conversion kit according to claim 6, wherein the radially inner surface of the body of the barrel liner has one or more helical grooves.

8. A conversion kit according to claim 6, wherein the radially inner surface of the body of the barrel liner is free of helical grooves and the barrel liner is for firing blank ammunition.

9. A conversion kit according to claim 1, wherein each of said plurality of barrel liners is in a finished machined state prior to being inserted into the barrel.

10. A conversion kit according to claim 1 wherein the retaining pin is a coiled spring pin.

11. A conversion kit according to claim 1, wherein the retaining pin engages in a channel through the barrel which is substantially perpendicular to the bore of the barrel or the longitudinal axis of the barrel.

12. A conversion kit according to claim 1, wherein the retaining pin engages in a groove or notch in a radially outer surface of the barrel liner to retain the barrel liner in position relative to the barrel for firing ammunition.

13. A conversion kit according to claim 1, wherein each barrel liner fits in the barrel with substantially no gap between the barrel and the barrel liner.

14. A conversion kit according to claim 1, wherein the bore of the barrel is substantially axial and substantially parallel with the longitudinal axis of the barrel.

15. A conversion kit according to claim 1, wherein a longitudinal axis of the bore of the barrel is at an angle to a longitudinal axis of the barrel at 1°±20% to ±20%.

16. A conversion kit according to claim 1, wherein the firearm is a pistol.

17. A firearm comprising the conversion kit of claim 1.

18. A firearm according to claim 17, comprising a pistol.

* * * * *